United States Patent [19]

Balduman

[11] 4,142,728

[45] Mar. 6, 1979

[54] MANCALA GAME BOARD ASSEMBLY

[76] Inventor: Agapito P. Balduman, 2709 Edfeldt Dr., District Heights, Md. 20028

[21] Appl. No.: 829,431

[22] Filed: Aug. 31, 1977

[51] Int. Cl.[2] ..... A63F 3/00

[52] U.S. Cl. ..... 273/242; 273/283; 273/285

[58] Field of Search ..... 273/242, 287, 283, 285

[56] References Cited

U.S. PATENT DOCUMENTS

| | | | |
|---|---|---|---|
| 2,292,219 | 8/1942 | Escuadra | 273/287 X |
| 2,319,159 | 5/1943 | Salomon | 273/287 X |
| 2,434,495 | 1/1948 | Holton | 273/287 UX |
| 2,720,362 | 10/1955 | Champion | 273/287 X |
| 3,170,696 | 2/1965 | Nielsen | 273/282 X |

FOREIGN PATENT DOCUMENTS

| | | | |
|---|---|---|---|
| 587636 | 1/1925 | France | 273/283 |
| 476480 | 12/1937 | United Kingdom | 273/242 |

OTHER PUBLICATIONS

A History of Board Games; H. J. R. Murray; Oxford Press; 1952; pp. 158–165, 171, 177, 190.

*Primary Examiner*—William H. Grieb
*Assistant Examiner*—Harry G. Strappello

[57] ABSTRACT

A mancala game board assembly having three boards arranged in triangular fashion for three players, one of the boards being easily removed and the remaining pair of boards arranged parallel one another for play by two players. Also disclosed is a method of playing mancala by two or more players involving simultaneous as well as serial play, and capture and collection of game pieces.

3 Claims, 6 Drawing Figures

MANCALA GAME BOARD ASSEMBLY

FIELD OF INVENTION

This invention relates to games and is especially concerned with a game board assembly for mancala.

BACKGROUND OF THE INVENTION

"Mancala" refers to any one of a great number of games having the common thread of keen arithmetical competition between two players in the distribution of pieces, commonly beans or pebbles, into rows of holes or pockets (such as in a board) under rules that permit the accumulation of pieces by capture. Such games are widely played in Africa and southern Asia and in those parts of the western hemisphere heavily influenced by Africa or Asiatic cultures, most notably the islands of the Caribbean where a form known as Wari is played under various rules.

One form of such a game and playing board known in this country is shown and described in U.S. Pat. No. 2,720,362 and U.S. Design Pat. No. 165,634, both issued to W.J. Champion. The game thus disclosed is marketed as KA LAH. The board for playing the game includes two series or rows of pockets or pits, one for each player. There are two "Ka Lahs" or goals (one for each player) at opposite ends of the board. A specific set of rules determines play and thus the accumulation of pieces by capturing the opponent's pebbles or marbles. A notable limitation of this game and other known forms of mancala is that only two players may play with the exception of a game known as OH-WAH-REE.

OH-WAH-REE is marketed by the Minnesota Mining and Manufacturing Co. of St. Paul, Minn. Two, three or four players may play the game, but the total number of pits or pockets provided for play remains the same, regardless of the number of players. For example, if there are 2 players, each player has 6 pockets and starts play with 4 pebbles or marbles in each pocket. If there are four players, each player gets only three pockets, each having 6 pebbles therein at the start of play. Consequently, the character and strategy of the game is greatly altered when more than 2 players play. Thus, as a practical matter, this game become a challenging battle of wits only when but 2 players are involved.

In comparison, the present invention provides a form of mancala wherein the desired, challenging characteristics of the game are maintained when 3 players are involved. A game board apparatus is provided for play by either 2 or 3 participants. A method of play is provided which hones arithmetical perception and thus educates the participants through play.

SUMMARY AND OBJECTS OF THE INVENTION

Accordingly, it is a primary object of the invention to provide a novel form of mancala game that may be played by two or three participants without significant altering of game rules or strategy of play.

It is another object of the invention to provide a novel game board assembly for playing a form of mancala which may optionably be arranged to accommodate two or three players.

It is a further object of the invention to provide a novel game board assembly for playing a form of a mancala by two or three participants wherein the assembly is of uncomplicated, economical construction.

The mancala game board assembly of this invention comprises three separately formed or structurally distinct game boards each having only a single straight row of pockets in which the last pocket in the row is used as a goal and is configured differently from the remainder of the pockets. Two of the game boards are pivotally attached to each other to permit one of the two boards to be pivoted or swung between a first position lying parallel and adjacent to the other game board and a second position angularly spaced from the first position where the angle between the two pivotally connected boards may be as much as 90 degrees. The third game board is detachably pivotally connected to one of the first two game boards mentioned above, permitting the three game boards to be arranged to define a triangle or the letter U.

Further novel features and other objects of this invention will become apparent as the description proceeds in connection with the appended claims and the below-described drawings.

DESCRIPTION OF THE PREFERRED EMBODIMENTS

Figure 1:
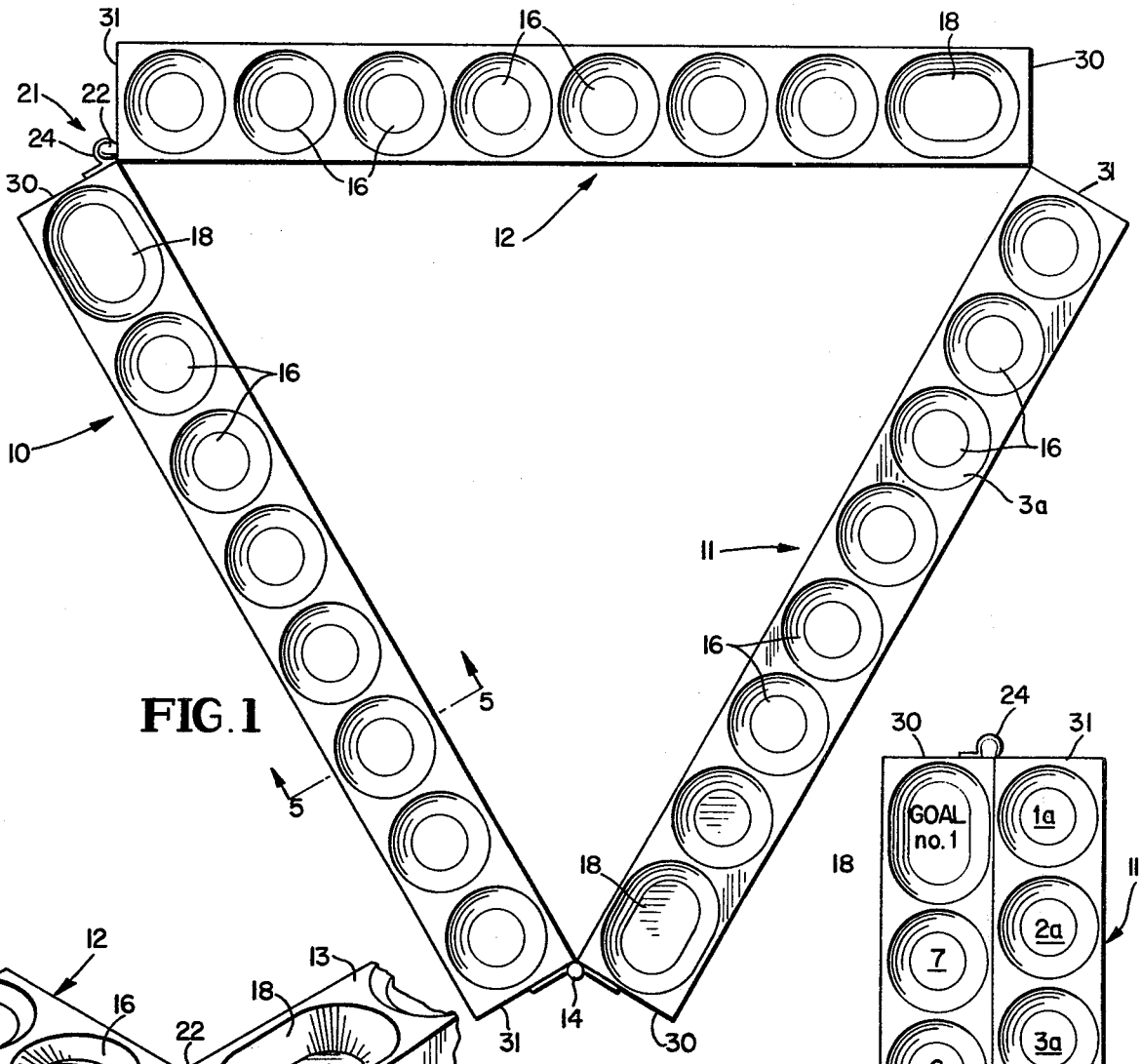
FIG. 1 is a plan view of the game board assembly of the invention, arranged for play by three persons.
Figure 3:
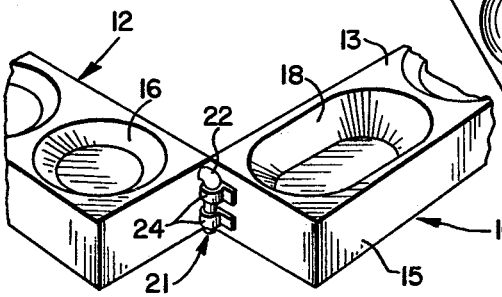
FIG. 3 is a fragmentary perspective view showing the detachable hinge assembly for the removable game board.

The game board assembly of this invention includes one game board for each player. For three players, consequently, three game boards are used as indicated at 10, 11 and 12 in FIG. 1. Except for the component parts for attaching boards 10–12 in assembled relationship, the game boards themselves are of identical construction. Boards 10 and 11 are permanently pivotally secured together at adjacent ends by any suitable structure such as a conventional flap hinge 14. Board 12 is detachably pivotally secured to board 10 and is only used to accommodate a third player.

As shown, each of the game boards 10–12 may be rectangular and has top and bottom wall surfaces 13 and 14 and flat, parallel side walls 15 and 17. Each of the boards 10–12 is formed with a series of multiplicity of upwardly opening, uniformly spaced apart playing pockets or bowl-like depressions 16 and a single, upwardly opening goal or pot 18. Goal 18 is also in the form of a pocket or bowl-like recess as shown.

Pockets 16 and goal 17 are arranged in a single straight row extending in the direction in which the game board is elongated. Goal 18 is located at one end of the row of pockets 16 adjacent to one end of the game board as shown. Pockets 16 extend between goal 18 and the other end of the game board. In the illustrated embodiment a vertical plane medially intersecting the game board medially intersects each of the pockets 16 and the goal 18.

As shown, pockets 16 are preferably of the same size and the same configuration. Goal 18 preferably has a configuration different from pockets 16. In the illustrated embodiment pockets 16 are circular in plan view, and goal 18 has an oblong configuration.

The number of playing pockets 16 in each board is pre-selected. In the illustrated embodiment seven such playing pockets are provided for so that including the goal there is a total of eight pockets or recesses on each game board, all arranged in a single row.

As shown in FIG. 1, the opposite ends of each of the game boards 10–12 are respectively indicated at 30 and 31. The goal 18 on each game board lies immediately adjacent to end 30.

Any suitable means may be employed to detachably pivotably secure board 12 to board 10. In the illustrated embodiment a post and eye hinge assembly 21 is used for this purpose and comprises a post 22 and a post-receiving eye portion 24. Post 22 is fixed to board 12 at end 31, and eye portion 24 is fixed to end 30 of board 10. Post 22 is rotatably and removably received in eye portion 24 so that game boards 10 and 12 can be relatively pivoted about a vertical axis. Hinge 14 also enables relative pivotal motion of boards 10 and 11 about a vertical axis.

As shown in FIG. 1, hinge 14 pivotally secures end 30 of board 11 to end 31 of board 10 so that the goals 18 on the two game boards are remote from each other at opposite ends of the assembly of the two boards rather than being adjacent to each other. When board 12 is secured to board 10, the goal 18 on board 10 will lie adjacent to end 31 of board 12 so that the goals on boards 10 and 12 also will not be adjacent to each other in the illustrated assembly of the three boards. Accordingly, when the players are seated outside of the triangular assembly of boards 10–12 (see FIG. 1) and face their respective boards, each player's goal or pot 18 will be on his left, and no two goals will be adjacent to each other.

Figure 2:
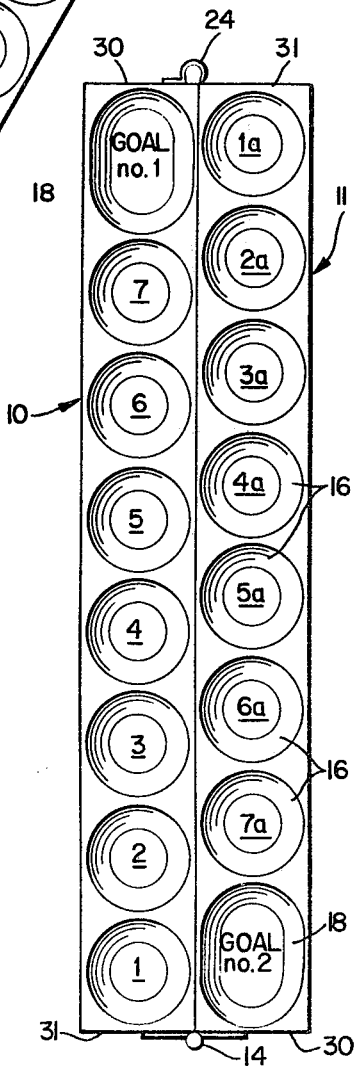
FIG. 2 is a plan view of the game board assembly arranged for play by two persons.

When there are only two players, board 12 may be detached from board 10 and removed from the assembly. Boards 10 and 11 are then pivoted relative to each other to fold or bring the two boards into parallel side-by-side relationship where the side wall 15 of board 10 butts against the side wall 17 of board 11 as shown in FIG. 2. In this position the rows of the pockets on boards 10 and 11 will be parallel with each other, with the two goals 18 being at opposite ends of the two-board sub-assembly.

To accommodate the third player, boards 10 and 11 are angularly spread apart by pivoting the boards about hinge 14. Board 12 is then pivotally attached to board 10 by assembly 21 and may be pivoted to a position where a corner on its free end (i.e., end 30) contacts the corner of the adjacently disposed end 31 of board 11 to form the triangular assembly as shown in FIG. 1. Alternatively, the free unattached ends of boards 11 and 12 (i.e., end 30 of board 12 and end 31 of board 11) may be spread apart by pivoting the two boards away from each other. With this movement, boards 11 and 12 may be moved to positions where they are approximately parallel to each other to make it convenient for the players sitting at a rectangular or square table.

Figure 5:
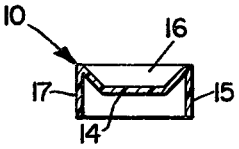
FIG. 5 is transverse cross-section view of one game board as taken, for example, along lines 5—5 of FIG. 1.
Figure 6:
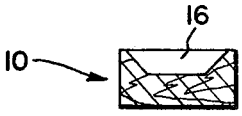
FIG. 6 is a section similar to FIG. 5 but showing an alternate form of construction.
Figure 4:
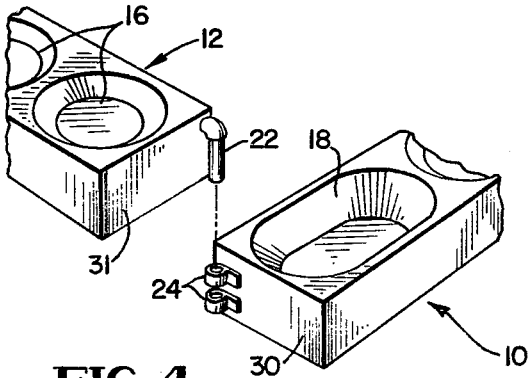
FIG. 4 is a exploded view of the structure shown in FIG. 3.

Each of the boards 10–12 may be constructed from molded plastics material such as polystyrene as indicated by FIG. 5 or of solid wood as illustrated in FIG. 6.

Of course, it is possible to play many varieties of mancala with the apparatus shown and described. However, one particularly desirable and challenging form of the game for two or three players is discussed hereinbelow.

A number of marbles or pebbles (not shown) are used as game pieces for distribution in the pockets 16 and for accumulation by capture in the goals 18. Marbles or pebbles are preferred since they are easy to handle. The object of the game is simple: a player tries to accumulate as many marbles as he can in his own goal to thus win the game.

Prior to the start of play for two, equal numbers of marbles are distributed in the pockets 16, which are numbered serially from 1 to 7 on board 10 from **1*a* to 7*a* on board 11, as is illustrated in FIG. 2. The number of marbles placed in each pocket is predetermined and, preferably, is the same as the number of pockets 16 provided in each of the boards 10 and 11. In the embodiment shown, each board 10, 12 has seven pockets. Accordingly, seven marbles or game pieces are placed in each pocket 1–7 and 1*a*–7*a***.

After distribution of the marbles, play is initiated.

First, both players move simultaneously, rather than alternately as in the case of conventional games. The players select a pocket on their game boards, remove all of the marbles therefrom and then seed the successive pockets 16 with one marble each, including their own goal, moving in clockwise fashion until the supply of picked-up marbles is exhausted. In seeding the marbles, the player does not place a marble in his opponent's goal.

For example, if the player having board 10 in FIG. 2 were to select pocket "1", he could seed the successive pockets 2–7 with one marble each and place the last marble in his own goal, which is marked "GOAL 1".

The pockets immediately adjacent the goals and marked "7" and "**7*a***" are nominated as "bonus" pockets. This means that any time a player finishes seeding by placing his last marble in his own goal, he may pick up all of the marbles in his bonus pocket and place them in his own goal.

Thus, it is clear that a good initial strategy is for player one to select pocket "1" on his first move so that he finishes seeding in his own goal and thus may remove the accumulation of all 8 marbles (the initial seven plus one from his first seeding move) from the bonus pocket "7" to his own goal. Similarly, it is wise for player two to select pocket "**1*a***" for his first move.

At the completion of this first exemplary set of simultaneous moves, each player will have nine marbles in his respective goal. Pockets "1", "7", "**1*a*" and "7*a*" will be empty and each of the pockets 2–6 and 2*a*–7*a* will have 8** marbles apiece.

On the next play, each player selects any pocket he wishes in his own board and seeds as before in clockwise fashion. Play continues to be conducted simultaneously but with succeeding moves being initiated from the pocket in which the player placed his last marble from the proceeding move. For example, if the last marble is placed in pocket 7 by one of the players, the player removes all of the marbles from pocket 7 and seeds them in the manner described above. However, if the seeding of the last marble in the proceeding play was that player's own goal, he removes the marbles from his bonus pocket "7" or "**7*a***", as the case may be, places them in his own goal and starts his next move from any pocket he desires on his board.

At no time does a player either remove marbles from or deposit any marbles in his opponent's goal.

Play continues in such simultaneous fashion until a player makes a move wherein the last marble of a seeding is deposited in an empty pocket. If this occurs, he stops play and his opponent continues, with as many plays as he can, until he too must terminate a play in an empty pocket. When this happens, the first player resumes play by selecting any pocket he wishes on his own board and continues until he must terminate a play in an empty pocket. The he stops and the second player resumes play by similarly selecting any pocket he wishes on his board and continuing until he again must terminate play in an empty pocket.

It should be noted that each player starts play by picking up the marbles from a selected pocket in only his own game board. Likewise, when the player resumes play after he was stopped by seeding his last marble in an empty pocket, he does so by selecting a pocket only from his own game board. He also may select any pocket, but only from his own game board, in the next play after he deposits his last marble in his own goal. However, when the last marble is seeded in one of the pockets 1–7 or **1*a*–7*a*** which already has one or more marbles therein, the player must select that pocket and continues play by removing the marbles in that pocket.

A strategic move for a player is to terminate a move in his opponent's bonus pocket. Thus, on his next move, he will remove all of the marbles from that pocket to initiate the seeding. Accordingly, his opponent is now deprived of his bonus supply of marbles and thus will acquire little if his next move ends at his own goal. Conversely, it is a poor move for a player to terminate a play in his own bonus pocket, since he will have to empty that pocket for his next move or seeding.

The first player to clear his row of pockets of all marbles acquires all of the marbles remaining in play on the opposite side of the board; he then placed these in his own goal. The game thus ends since no more marbles remain in play. The player having the most marbles in his goal wins the game.

For three players, play is essentially the same, except that after simultaneous play is terminated, the three players will take turns in an order determined by the order in which they dropped out of the simultaneous playing stage. For example, assume the players are A, B and C having boards 10, 11 and 12 respectively.

Simultaneous play by all three players proceeds in the same manner just described until one player seeds his last marble in an empty playing pocket (16). Assume that player A is the first to seed his last marble on a given play in an empty pocket. Thereafter, player A temporarily withdraws from play, and players B and C continue the simultaneous play until one of the two seeds his last marble in an empty pocket. Assume that this happens to player B. Now player C continues to play alone until he seeds his last marble on a given play in an empty pocket. Thereafter the three players take turns, starting with A, then B and finally C.

For the assembly of all three game boards 10–12, clockwise seeding of the marbles is the same as that already described except, of course, for the addition of one more row of seeding pockets 16. For example, assume that players A, B and C are assigned boards 10, 11 and 12 respectively and that player C has just deposited his last marble in A's bonus pocket where there are already 10 marbles. Player C then picks up all of the marbles (11 in all) from A's bonus pocket, skips A's goal and seeds them in a clockwise direction one in each of the successive pockets 16 and his own goal. The last marble will then be deposited in the third pocket marked **3*a* in B's board 11**.

When all three of the boards 10–12 are used to accommodate an equal number of players, it will be appreciated that seven marbles are deposited in each of the pockets 16 on each of the three boards before play starts.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A mancala game board assembly comprising first, second and third separately formed, elongated rectangular game boards of like construction, each of said game boards having (a) first and second spaced apart ends, (b) flat parallel side walls extending between said first and second ends, (c) an array of upwardly opening playing pockets for receiving mancala game pieces and all arranged in a single row that extends in the direction in which the game board is elongated such that a plane medially intersecting the game board medially intersects said pockets, (d) the pocket at one end of said row being disposed immediately adjacent to said first end and being larger than the remaining ones of the pockets in said row to act as the goal pocket in playing the mancala game, and (e) said remaining ones of said pockets being uniformly configured and being uniformly spaced apart along the portion of the game board that extends between said goal pocket and said second end, the number of said pockets in the row of each of said boards being the same and pre-selected, and said mancala game board assembly further comprising first means pivotally securing said first end of said second board to said second end of said first board for enabling pivotal displacement of said second board between first and second angularly spaced apart positions and for locating said first end of said second board immediately adjacent to said second end of said first board when said second board is in either one of said first and second angularly spaced apart positions, said second board being angularly spaced apart from said first board by at least an acute angle when pivoted to said second position, and said first and second boards lying in parallel side-by-side abutting relationship with each other when said second board is pivoted to said first position, the row of said pockets on said second board being parallel to the row of said pockets on said first board when said second board is in said first position, said second end of said second board lying immediately adjacent to said first end of said first board when said second board is in said first position, then first end of said first board and said second end of said second board being the free relatively movable ends of said first and second boards, and second means detachably pivotally securing one of the ends of said third board to a pre-selected one of the free ends of said first and second boards for enabling pivotal displacement of said third board to a position where the other of the ends of said third board contacts the free end of the other one of said first and second boards when said second board is in said second position to form a triangle in which said first end and said goal pocket of said third board lies immediately adjacent to said second end of said second board, in which said first end and said goal pocket of said first board lies immediately adjacent to said second end of said third board, and in which said first end and said goal pocket of said second board lies immediately adjacent to said second end of said first board, whereby a three sided mancala game board is formed for game participation by three players, and said third game board being selectively removable from said triangle for enabling said second board to be moved to said first position for game participation by two players.

2. The mancala game board assembly as claimed in claim 1 wherein said second means comprise a hook and eye hinge assembly whereby said third board may be disengaged from the sub-assembly of said first and second boards by vertically lifting said third board therefrom.

3. The mancala game board assembly defined in claim 2 wherein the number of pockets in the array of pockets on each of said boards is eight including said goal pocket.

* * * * *